US007854321B2

(12) United States Patent
Twig et al.

(10) Patent No.: US 7,854,321 B2
(45) Date of Patent: Dec. 21, 2010

(54) ROLLING CONTAINER ASSEMBLY

(75) Inventors: Noam Twig, Petach Tikva (IL); Gil Vilkomirski, Petach-Tiqwa (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 12/165,715

(22) Filed: Jul. 1, 2008

(65) Prior Publication Data

US 2010/0000893 A1 Jan. 7, 2010

(51) Int. Cl.
*B65D 85/00* (2006.01)

(52) U.S. Cl. ..... 206/373; 206/372; 206/477; 206/483; 220/756; 248/316.1; 248/316.4; 280/47.26; 280/47.35

(58) Field of Classification Search ..... 206/372, 206/373, 349, 477, 483; 220/915.2, 756, 220/761; 248/316.1, 316.2, 316.4; 16/111.1, 16/405, 429; 211/70.6, 85.8; 280/47.26, 280/47.315, 47.35, 47.371, 79.2
See application file for complete search history.

(56) References Cited

U.S. PATENT DOCUMENTS

| | | | | | |
|---|---|---|---|---|---|
| 353,725 | A | | 12/1886 | White | |
| 1,657,854 | A | * | 1/1928 | Clemensen | 206/372 |
| 1,933,894 | A | * | 11/1933 | Clink | 220/259.2 |
| 3,979,007 | A | | 9/1976 | Thornbloom, Jr. | |
| 4,714,158 | A | * | 12/1987 | Oltman et al. | 206/349 |
| 4,840,273 | A | * | 6/1989 | Zavacki | 206/372 |
| 4,873,841 | A | * | 10/1989 | Bradshaw et al. | 62/239 |
| 4,895,068 | A | * | 1/1990 | Hanagan et al. | 99/357 |
| D314,279 | S | * | 2/1991 | Hotchkiss | D3/309 |
| 5,011,013 | A | | 4/1991 | Meisner et al. | |
| 5,193,706 | A | | 3/1993 | Hanna et al. | |
| 5,228,706 | A | | 7/1993 | Boville | |
| 5,259,215 | A | | 11/1993 | Rocca | |
| 5,305,381 | A | * | 4/1994 | Wang et al. | 379/455 |
| 5,313,817 | A | | 5/1994 | Meinders | |
| 5,370,263 | A | * | 12/1994 | Brown | 220/751 |
| 5,373,708 | A | | 12/1994 | Dumoulin, Jr. | |
| 5,431,298 | A | | 7/1995 | Ahn et al. | |
| 5,535,881 | A | * | 7/1996 | Krivec | 206/376 |
| 5,601,206 | A | * | 2/1997 | Haas et al. | 220/527 |
| 5,680,932 | A | * | 10/1997 | Dickinson et al. | 206/372 |
| 5,762,411 | A | * | 6/1998 | Yemini | 312/290 |
| 5,788,072 | A | * | 8/1998 | Chen | 206/372 |
| 5,816,374 | A | * | 10/1998 | Hsien | 190/115 |
| 5,826,719 | A | * | 10/1998 | Chen | 206/373 |
| 5,836,563 | A | * | 11/1998 | Hsin-Yung | 248/316.4 |

(Continued)

*Primary Examiner*—David T Fidei
(74) *Attorney, Agent, or Firm*—Pillsbury Winthrop Shaw Pittman LLP

(57) ABSTRACT

A tool container assembly includes a base container, a cover, rollers, a removable tool tray, and an extendable handle. The base container includes a storage space, and an upwardly facing opening into the storage space. The cover is movable between a closed position in which it substantially covers the upwardly facing opening and an open position in which it exposes the upwardly facing opening. The rollers are connected with the base container to enable transport of the tool container assembly. The removable tool tray is constructed and arranged to be removably carried by the base container and the tool tray is configured to store articles or tools therein. The extendable handle is operatively connected to the base container to facilitate tilted rolling transport of the tool container assembly. The removable tool tray is constructed to securely engage with the handle when the handle is in an extended position.

21 Claims, 14 Drawing Sheets

U.S. PATENT DOCUMENTS 5,906,291 A 5/1999 Mann et al.
5,927,451 A * 7/1999 Tsai ..... 190/115
5,947,359 A * 9/1999 Yoshie ..... 224/570
5,988,658 A 11/1999 Ritchie et al.
6,260,700 B1 * 7/2001 Huang ..... 206/373
6,360,083 B1 * 3/2002 Fan ..... 455/90.1
6,364,329 B1 * 4/2002 Holub et al. ..... 280/47.26
6,449,993 B2 9/2002 Elliott et al.
6,554,239 B2 * 4/2003 Stilley et al. ..... 248/309.1
6,581,499 B2 * 6/2003 Myers ..... 82/113
6,585,090 B2 7/2003 Harvey
6,601,930 B2 8/2003 Tiramani et al.
6,648,390 B1 11/2003 Yang
6,655,529 B2 * 12/2003 Ho ..... 206/373
6,761,366 B1 * 7/2004 Klemmensen et al. ... 280/47.26
6,997,315 B2 * 2/2006 Myer et al. ..... 206/372
7,017,740 B2 * 3/2006 Itzkovitch ..... 206/372
7,066,476 B2 * 6/2006 Elden ..... 280/37
7,155,859 B1 * 1/2007 Brooks ..... 43/54.1
7,246,718 B2 7/2007 Einav et al.
7,284,763 B1 * 10/2007 King ..... 280/47.26
7,287,665 B2 * 10/2007 Meissen et al. ..... 220/766
7,306,243 B2 * 12/2007 Van Horn et al. ..... 280/30
7,513,633 B2 * 4/2009 Ermeti ..... 362/84
2001/0030403 A1 * 10/2001 Johnson et al. ..... 280/47.26
2003/0209883 A1 * 11/2003 Hsia ..... 280/643
2004/0134818 A1 * 7/2004 Cunningham et al. ..... 206/373
2004/0234082 A1 11/2004 Rosental et al.
2005/0011788 A1 1/2005 Hsien
2005/0127081 A1 6/2005 Leba et al.
2005/0133394 A1 6/2005 Liu
2005/0247587 A1 11/2005 Holland-Letz
2006/0157944 A1 * 7/2006 Alexander ..... 280/47.18
2006/0243617 A1 11/2006 Brunson et al.
2007/0074984 A1 4/2007 Liu
2007/0075508 A1 * 4/2007 Miller et al. ..... 280/47.26
2007/0103892 A1 5/2007 McDaniel et al.
2007/0158222 A1 7/2007 Chi
2009/0057633 A1 * 3/2009 Beck et al. ..... 254/420

* cited by examiner

ROLLING CONTAINER ASSEMBLY

BACKGROUND OF THE INVENTION

Field of the Invention

The present invention relates to a tool container assembly.

Numerous tool container assemblies are known in the art. However, there is a constant need in the industry to improve upon existing tool container assemblies by making them more efficient, cost-effective, mobile, and/or multi-functional.

SUMMARY OF THE INVENTION

One aspect of the invention relates to a tool container assembly. The tool container assembly includes a base container, a cover, rollers, a removable tool tray, and an extendable handle. The base container includes a storage space, and an upwardly facing opening into the storage space. The cover is movable between a closed position, where the cover substantially covers the upwardly facing opening and an open position, where the cover exposes the upwardly facing opening. The rollers are connected with the base container to enable transport of the tool container assembly. The removable tool tray is constructed and arranged to be removably carried by the base container. The removable tool tray is configured to store articles or tools therein. The extendable handle is operatively connected to the base container to facilitate tilted rolling transport of the tool container assembly. The removable tool tray is constructed to securely engage with the handle when the handle is in an extended position.

Another aspect of the invention relates to a tool container assembly. The tool container assembly includes a base container, a cover, rollers, an extendable handle, and at least one clamp assembly. The base container includes a storage space, and an upwardly facing opening into the storage space. The cover is movable between a closed position, where the cover substantially covers the upwardly facing opening and an open position, where the cover exposes the upwardly facing opening. The rollers are connected with the base container to enable transport of the tool container assembly. The extendable handle is operatively connected to the base container to facilitate tilted rolling transport of the tool container assembly. The at least one clamp assembly is disposed on an inner surface of the cover to clamp a tool or article to the cover.

Another aspect of the invention relates to a tool container assembly. The tool container assembly includes a base container, rollers, cover, and an extendable handle. The base container includes a storage space, and an upwardly facing opening into the storage space. The base container also includes a pair of side walls, a front wall, and a rear wall, and a bottom wall. The cover is movable between a closed position wherein the cover substantially covers the upwardly facing opening and an open position wherein the cover exposes the upwardly facing opening. The rollers are connected with the base container to enable transport of the tool container assembly. The rollers are disposed towards a rearward portion of the bottom wall. The extendable handle is operatively connected to the base container to facilitate tilted rolling transport of the tool container assembly. The bottom wall includes a forward portion thereof disposed further from the cover than intermediate portions thereof, such that when the tool container assembly is at rest, only the rollers and the forward portion of the base wall contact a horizontal surface on which the tool container assembly is placed.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF THE INVENTION

Figure 1:
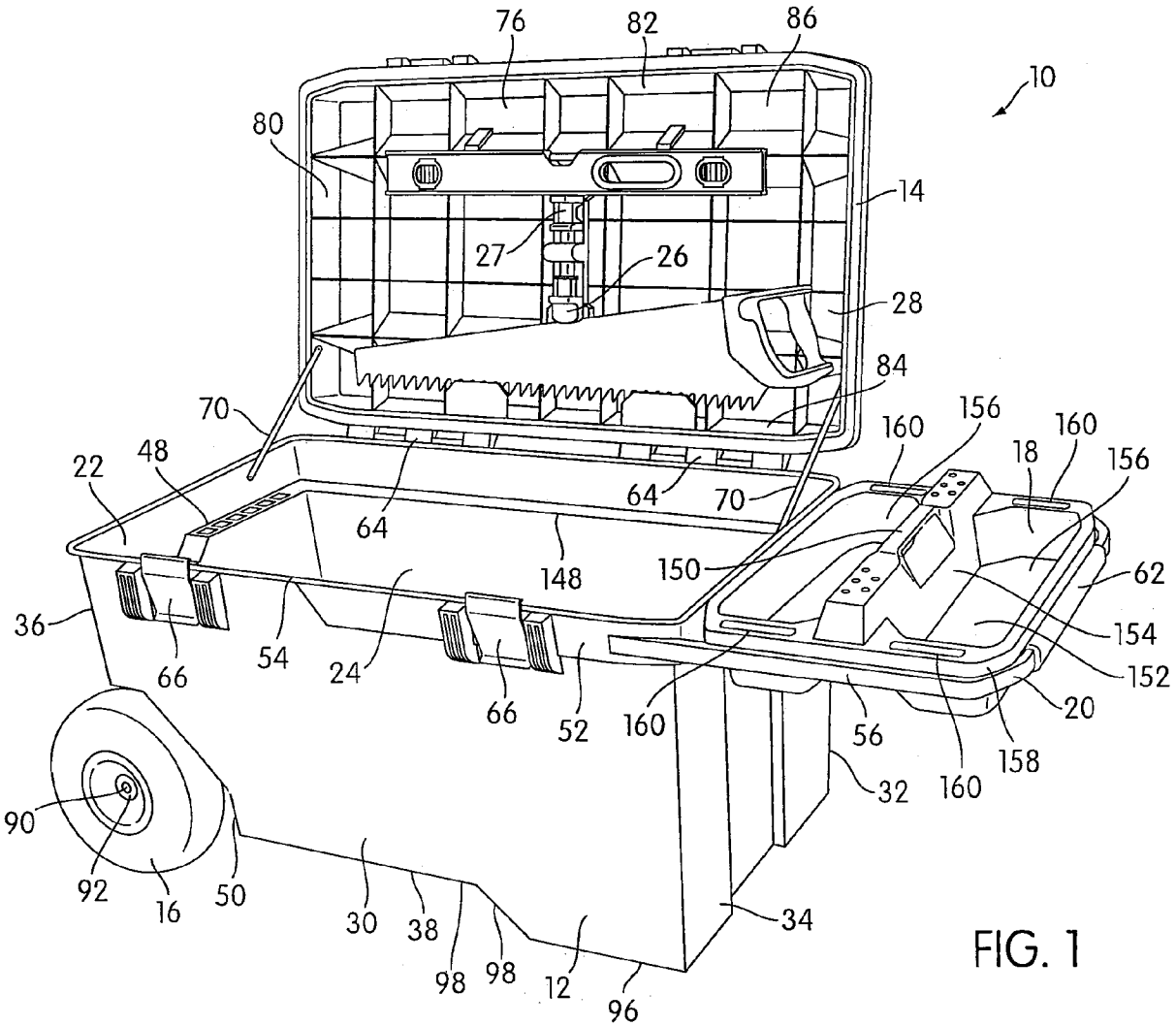
FIG. 1 is a perspective view of the tool container assembly, where cover is in an open position in accordance with an embodiment of the present invention.
Figure 2:
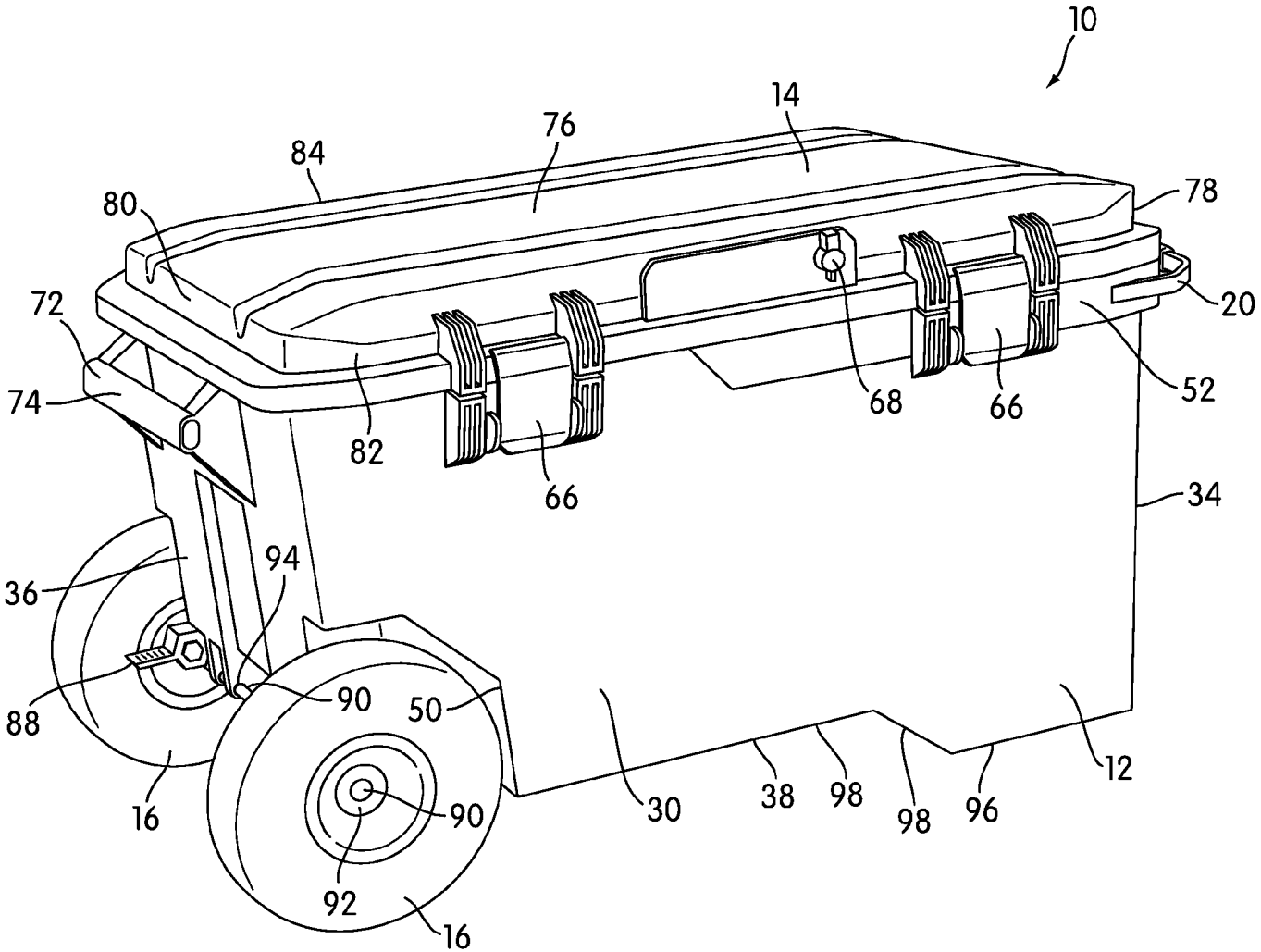
FIG. 2 is a perspective view of the tool container assembly, where the cover is in a closed position in accordance with an embodiment of the present invention.
Figure 3:
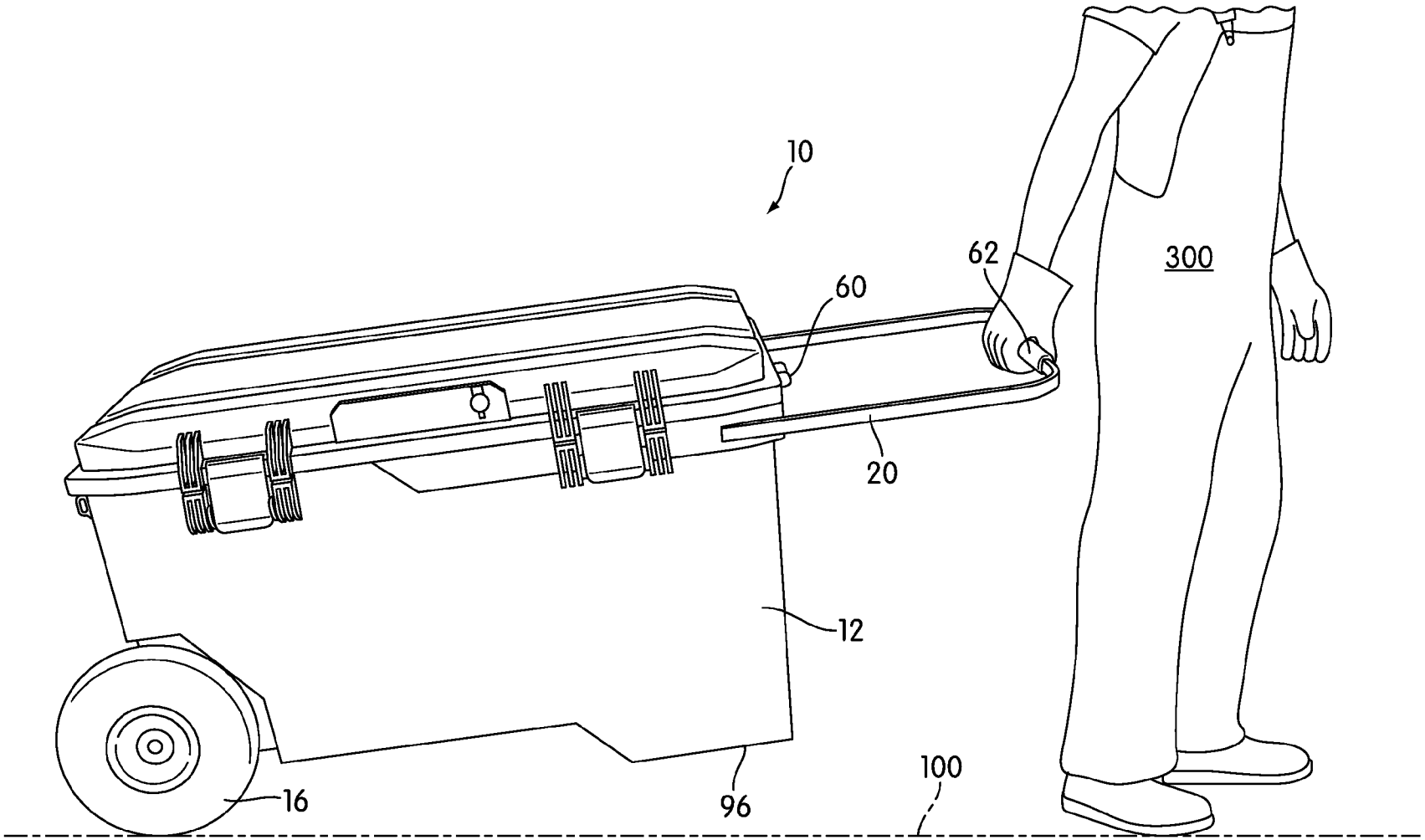
FIG. 3 is a perspective view of the tool container assembly, where the tool container assembly is being tilted, and rollingly transported using an extendable handle in accordance with an embodiment of the present invention.

FIGS. 1 and 2 show a tool container assembly 10 in accordance with an embodiment of the present invention. In one embodiment, the tool container assembly 10 may generally include a base container 12, a cover 14, rollers 16, a removable tool tray 18, and an extendable handle 20. The base container 12 includes a storage space 22 and an upwardly facing opening 24 into the storage space 22. The cover 14 is movable between a closed position (as shown in FIG. 2) wherein the cover 14 substantially covers the upwardly facing opening 24 and an open position (as shown in FIG. 1) wherein the cover 14 exposes the upwardly facing opening 24. The rollers 16 are connected with the base container 12 to enable transport of the tool container assembly 10. The removable tool tray 18 is constructed and arranged to be removably carried by the base container 12. The removable tool tray 18 is configured to store articles or tools therein. The extendable handle 20 is operatively connected to the base container 12 to facilitate tilted rolling transport (as shown in FIG. 3) of the tool container assembly 10. The removable tool tray 18 is constructed to securely engage with the handle 20 when the handle 20 is in an extended position. In one embodiment, the tool container assembly 10 includes at least one clamp assembly 26 and/or 27, where the at least one clamp assembly 26 and/or 27 is disposed on an inner surface 28 of the cover 14 to clamp tools or articles to the cover. The construction and arrangement of the clamp assemblies 26 and 27 is explained in detail with respect to FIGS. 7-10.

In one embodiment, the base container 12 of the tool container assembly 10 includes a pair of side walls 30 and 32, a front wall 34, and a rear wall 36, and a bottom wall 38. The front wall 34, the rear wall 36 and the opposed side walls 30 and 32 are constructed and arranged to generally extend vertically upwardly from the bottom wall 38. The front wall 34 and the rear wall 36 are joined to each other by the opposed side walls 30 and 32 to form the aforementioned storage space 22 therewithin with the upwardly facing opening 24 in the base container 12. In one embodiment, the base container 12 is formed from a suitable molded plastic material.

In one embodiment, the bottom wall 38 includes a forward portion 96 thereof disposed further from the cover 14 than intermediate portions 98 thereof, such that when the tool container assembly 10 is at rest, only the rollers 16 and the forward portion 96 of the bottom wall 38 contact a horizontal surface 100 (as shown in the FIGS. 3, 4 and 5) on which the tool container assembly 10 is placed, as will be explained in detail with respect to FIG. 5.

In one embodiment, a storage compartment 48 is constructed and arranged in the storage space 22 of the base container 12 to store one or more tools or articles, as will be discussed in detail with respect to FIG. 6A. A recess 50 is formed in opposing side walls 30 and 32, and rear wall 36 of the base container 12. The recess 50 is constructed and arranged to accommodate the rollers 16 therewithin. The base container 12 includes a pair of handle receiving portions 52 formed near a top edge 54 along the opposing side walls 30 and 32. The handle receiving portion 52 are constructed and arranged to receive the handle 20 therewithin, when the handle is in a retracted position. In one embodiment, the handle receiving portions 52 are hollow structures that are configured to telescopically receive legs 56 of the handle 20 to enable extension and retraction respectively.

In one embodiment, the cover 14 may be pivotally connected to the side wall 32 of the base container 12 using hinge members 64. The cover 14 may be secured in the closed position, as shown in FIG. 2, by at least one latch 66 (two are shown). In one embodiment, a cover lock assembly 68 (e.g., a key or combination lock) may be provided to lock the cover 14 in the closed position. By releasing the latches 66 and unlocking the cover lock assembly 68, the cover 14 may be pivoted about the hinge members 64 to the open position (as shown in FIG. 1) to access the tools or articles stored in the storage space 22 of the base container 12 of the tool container assembly 10. In one embodiment, the cover 14 may be coupled to the front wall 34 and/or the rear wall 36 of the base container 12 using at least one linkage member 70 (two are shown). The linkage members 70 are constructed and arranged to support the cover 14 when the cover 14 is in open position (as shown in FIG. 1). The linkage members 70 may also be configured to act as a stop to limit the movement of the cover 14 beyond a maximum open position of the cover 14. In one embodiment, the linkage members 70 are made from a flexible material (such as a chain, wire, rope or string, for example) so that the linkage members 70 are in a slack configuration, when the cover 14 is in the closed position (as shown in FIG. 2).

The cover 14 generally includes a top wall 76, a front wall 78, a rear wall 80, and opposed side walls 82 and 84. The front wall 78, rear wall 80 and opposed side walls 82 and 84 are constructed and arranged to generally extend vertically downwardly from the top wall 76 (when the container assembly 10 is resting on the ground as shown in FIG. 5). The front wall 78 and the rear wall 80 are joined to each other by the opposed side walls 82 and 84 to form a recess or cavity 86 in the cover 14. The inner side of cover 14 is constructed and arranged to accommodate one or a plurality of clamp assemblies, as will be clear from the discussions with respect to FIGS. 7-10. In one embodiment, the cover 14 is formed from a suitable molded plastic material.

In one embodiment, the rollers 16 may be in the form of wheels and may facilitate rolling transport of the tool container assembly 10. As noted above, the rollers 16 are mounted in the recess 50 formed in the base container 12 so that the tool container assembly 10 may be tilted and pulled or pushed along the horizontal surface 100 (e.g., ground surface) by the user holding the handle 20. The rollers 16, in one embodiment, may optionally be locked against rolling motion by roller lock members 88 that are operatively connected to the rollers 16 to provide a stationary configuration.

Preferably the each wheel 16 is a molded structure reinforced by a plurality of wheel ribs (not shown) and each wheel 16 is mounted on an end of an elongated axle 90 by two hubs 92 or other appropriate structure. The axle 90 may be an elongated cylindrical steel shaft that is snap fit into rotational engagement with a receiving structure of the base container 12 in conventional fashion. Alternatively, the axle 90 can be mounted to the tool container assembly 10 through a pair of axially aligned through-holes 94 formed in the rear wall 36 of the base container 12.

The removable tool tray 18 is, in one embodiment, constructed of a suitable molded plastic material. When contained within the tool container assembly 10, the tool tray 18 is disposed within the storage space 22 of the base container 12, and rests on protrusions (not shown) or a lip 148 which form support surfaces that are integrally formed in the walls of the base container 12. In the illustrated embodiment, as shown in FIG. 6B, the tool tray 18 covers only a portion of the upwardly facing opening 24. In such embodiment, the user can access the space 22 within the container 12 without removing tray 18. In one embodiment, the removable tool tray 18 includes an integrally formed handle 150 that is formed in a central region of the tool tray 18 to assist a user in lifting and carrying the tool tray 18. In one embodiment, not shown, the tool tray 18 may extend across the entire container base 12, when the tool tray 18 is disposed within the storage space 22 of the base container 12. In such embodiment, the tool tray 18 generally divides the storage space 22 of the base container 12 into an upper region, which is defined by the space confined by the cover 14 and tool tray 18, and a lower region, which is defined by the space confined by the tool tray 18 and the four walls and bottom wall of the base container 12.

A bottom surface 152 of the tool tray 18 is shaped (e.g., preferably by molding) to include a plurality of integral vertically extending wall portions 154 (e.g., only one is shown) that partition the tray 18 into a plurality of containing regions 156. The containing regions 156 may be constructed and arranged to have different sizes, shaped and configurations to hold tools, articles and other hardware. The tool tray 18 can be provided with a peripheral flange 158 that can rest along the lip 148 of the base container 12 when the tool tray 18 is disposed in the storage space 22. Alternatively, in another embodiment, the tool tray 18 is sufficiently small to fit entirely within the base container 12 such that the tool tray 18 rests on the bottom wall 38 of the base container 12. In the illustrated embodiment, a plurality of smaller storage openings 160 may be formed in the tool tray 18. The plurality of tool storage openings 160 are constructed and arranged to permit the storage of a variety of articles, such as screws, nails or other similar articles or hardware having different shapes and sizes. In one embodiment, the tool storage openings 160 may have different shapes, configurations and/or constructions. For example, as shown in the illustrated embodiment, the tool storage openings 160 may be in form of longitudinal slots.

When the cover 14 of the tool container assembly 10 is in the open position (as shown in FIG. 1), the tool tray 18 can optionally be supported by resting its peripheral flange 158 on the legs 56 of the handle 20. In such embodiment, the handle 20 is in extended position with the legs 56 extending out of the handle receiving portions 52 of the base container 12. The operation of removing the tool tray 18 from the storage space 22 and securely engaging with handle 20 (e.g., when the handle 20 is in extended position) is explained with respect to FIG. 6.

Figure 4:
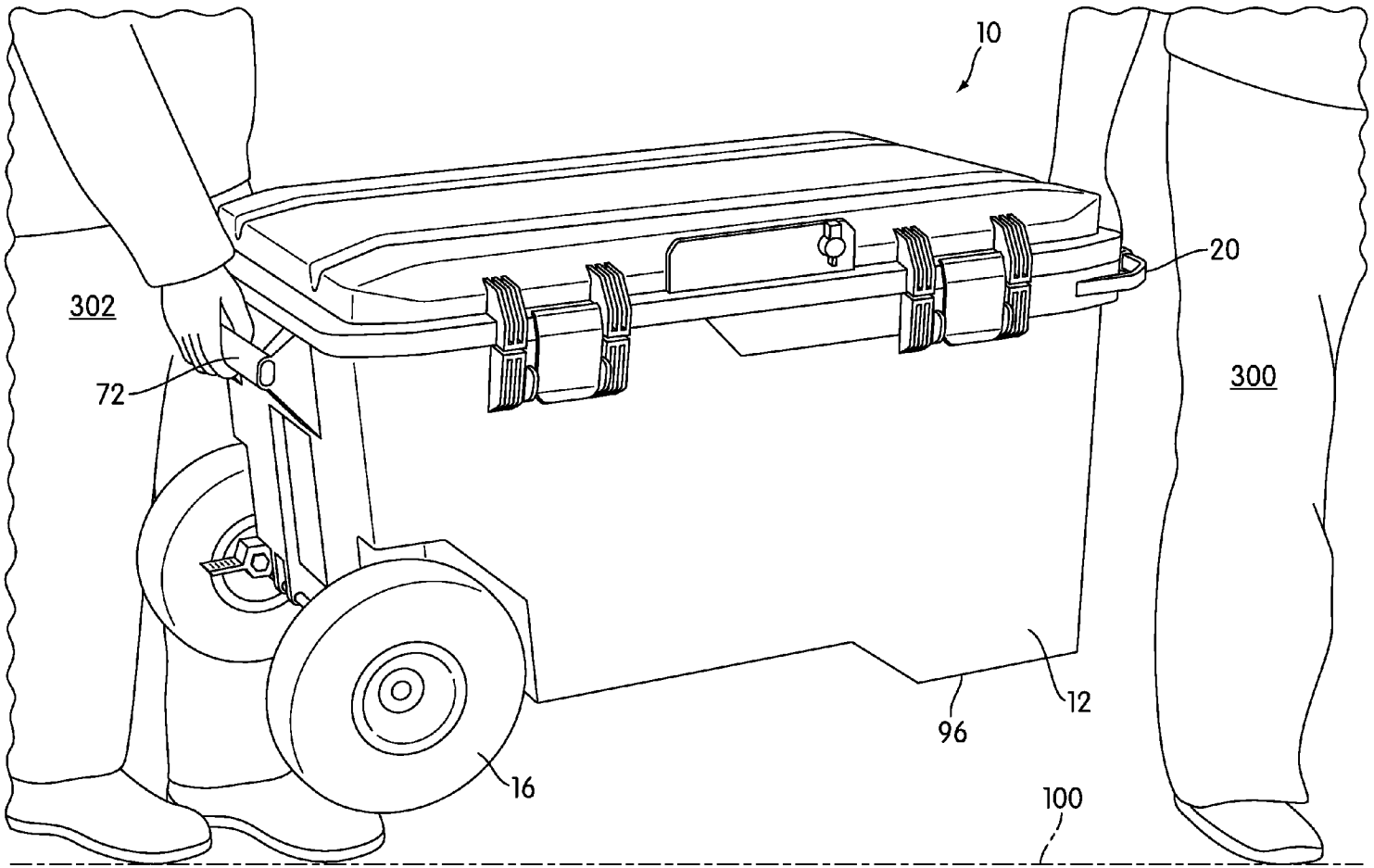
FIG. 4 is a perspective view of the tool container assembly, where the tool container assembly is being lifted off a horizontal surface and transported using the extendable handle and an integrally molded handle in accordance with an embodiment of the present invention.

The extendable handle 20 may be constructed and arranged to be linearly movable horizontally between the retracted position (as shown in FIGS. 2 and 4) and the extended position (as shown in FIGS. 1 and 3). In the extended position, the handle 20 facilitates tilted rolling transport (as shown in FIG. 3) of the tool container assembly 10, and supports the removable tool tray 18 when the tool container assembly 10 is at rest (as shown in FIG. 1). In the retracted position, the handle 20 is stored in the handle receiving portions 52 of the base container 12 (as shown in FIG. 2) and may also serve as a lifting handle to lift and carry the tool container assembly 10 (as shown in FIG. 4). The tool container assembly 10 may include a lock 58 and a handle release member 60 for locking the extendable handle 20 when the handle 20 is in retracted position or in extended position, as will be described with respect to FIG. 12. In one embodiment, the handle 20 facilitates the user a secure grip by hand grip 62. In one embodiment, the extendable handle 20 is generally a U-shaped member. The handle 20 is preferably a tubular structure and made of a metallic material such as steel or aluminum, but may also be a solid (i.e., non-tubular) structure of and may be made of a plastic or other suitable material.

In one embodiment, a handle 72 is integrally molded to the exterior rear wall 36 of the base container 12. In one embodiment, the handle 72 is in the form of a lifting handle. In such embodiment, the lifting handle 72, in combination with the extendable handle 20, is constructed and arranged to enable the user to lift and carry the tool container assembly 10 as shown in FIG. 4. In such embodiment, the extendable handle 20 may be in the retracted position. In one embodiment, the handle 72 facilitates the user a secure grip by hand grip portion 74.

FIG. 3 shows the tool container assembly 10 being rollingly transported on the rollers 16 using the extendable handle 20. In the illustrated embodiment, when the tool container assembly 10 is ready to transport the stored tools or articles, a user 300 extends the handle 20 into the extended position by operating the handle release member 60, as will be described in detail with respect to FIG. 12. The user 300 then the holds and lifts the hand grip 62 of the handle 20 upwardly to pivot the forward portion 96 of the base container 12 off the horizontal surface 100 using the extendable handle 20 so that only the rollers 16 are in contact with the horizontal surface 100, thus, the extendable handle 20 facilitates tilted rolling transport of the tool container assembly 10. The user 300 can then push or pull on the extendable handle 20 to roll and steer the tool container assembly 10 easily to and from a work location. When the user 300 lowers the base container 12, the forward portion 96 of the bottom wall 38 comes into contact with the horizontal surface 100 to stably support the tool container assembly 10.

Alternatively, as shown in FIG. 4, the tool container assembly 10 may be transported by completely lifting the tool container assembly 10 off the horizontal surface 100 and carrying the tool container assembly 10 using the lifting handle 72 and the extendable handle 20. In such embodiment, both the rollers 16 and the forward portion 96 of the base container 12 are out of contact with the horizontal surface 100. In such embodiment, the extendable handle 20 may be locked in the retracted position using the handle lock/release member 60 and may be in the form of a lifting handle.

Figure 5:
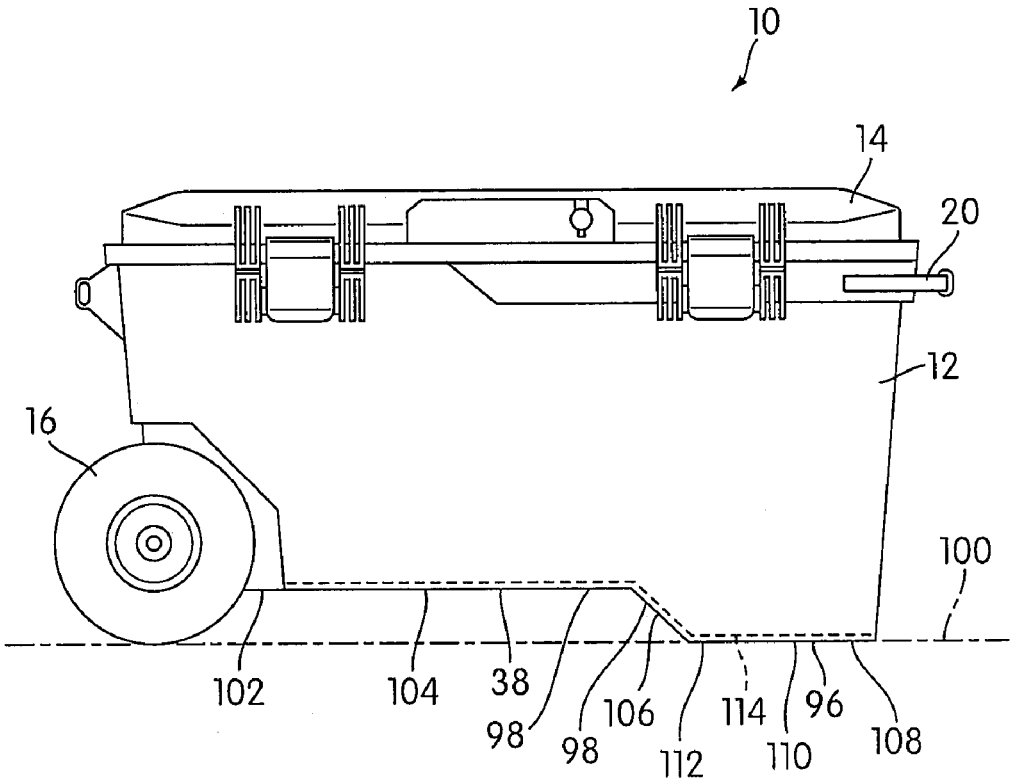
FIG. 5 is a side view of the tool container assembly, where the tool container assembly is at rest such that only rollers and forward portion of base wall contact a horizontal surface on which the tool container assembly is placed in accordance with an embodiment of the present invention.

FIG. 5 shows the tool container assembly 10 being placed in a stationary configuration on the horizontal surface 100. In one embodiment, the horizontal surface 100 is a ground surface. As noted earlier, the rollers 16 may be locked against rolling motion by the roller lock members 88 (as shown in FIG. 2). In one embodiment, the bottom wall 38 of the base container 12 includes a rearward portion 102 and the aforementioned forward portion 96. In one embodiment, the rollers 16 are disposed towards the rearward portion 102 of the bottom wall 38. As noted earlier, the forward portion 96 of the bottom wall 38 is disposed further from the cover 14 than the intermediate portions 98 of the bottom wall 38, such that when the tool container assembly 10 is at rest, only the rollers 16 and the forward portion 96 of the bottom wall 38 contact the horizontal surface 100 on which the tool container assembly 10 is placed.

The bottom wall 38 also includes a first, generally planar portion 104 extending away from the rollers 16, and an sloped portion 106 extending downwardly away from the planar portion 104. The sloped portion 106 may, in one embodiment, be considered part of the intermediate portion 98. However, the sloped portion 106 may also be considered to be a separate portion connected with the intermediate portion 98. In one embodiment, the first planar portion 104 of the bottom wall 38, and the rearward portion 102 of the bottom wall 38 are elevated by a distance d from the horizontal surface 100 on which the tool container assembly 10 is placed. In one embodiment, the intermediate portion 106 may generally lie in a sloping plane that extends away from the planar portion 104 as the intermediate portion 106 extends downwardly. The forward portion 96 of the bottom wall 38 defines a support surface 108 for the tool container assembly 10. The support surface 108, may in one embodiment be generally parallel to the first planar portion 104 of the bottom wall 38. However, other configurations are also contemplated, such as rounded or angled support surface. The forward portion 96 of the illustrated embodiment includes a lower, outer surface 110 defining the support surface 108 on which the tool container assembly 10 rests, and an inner, upper surface 112 defining an internal surface 114 within the base container 12. The inner upper surface 114 is generally parallel to the outer, lower surface 110, such surfaces 110 and 114 basically defining opposite sides of the bottom wall 38 at the forward portion 96.

Figure 6:
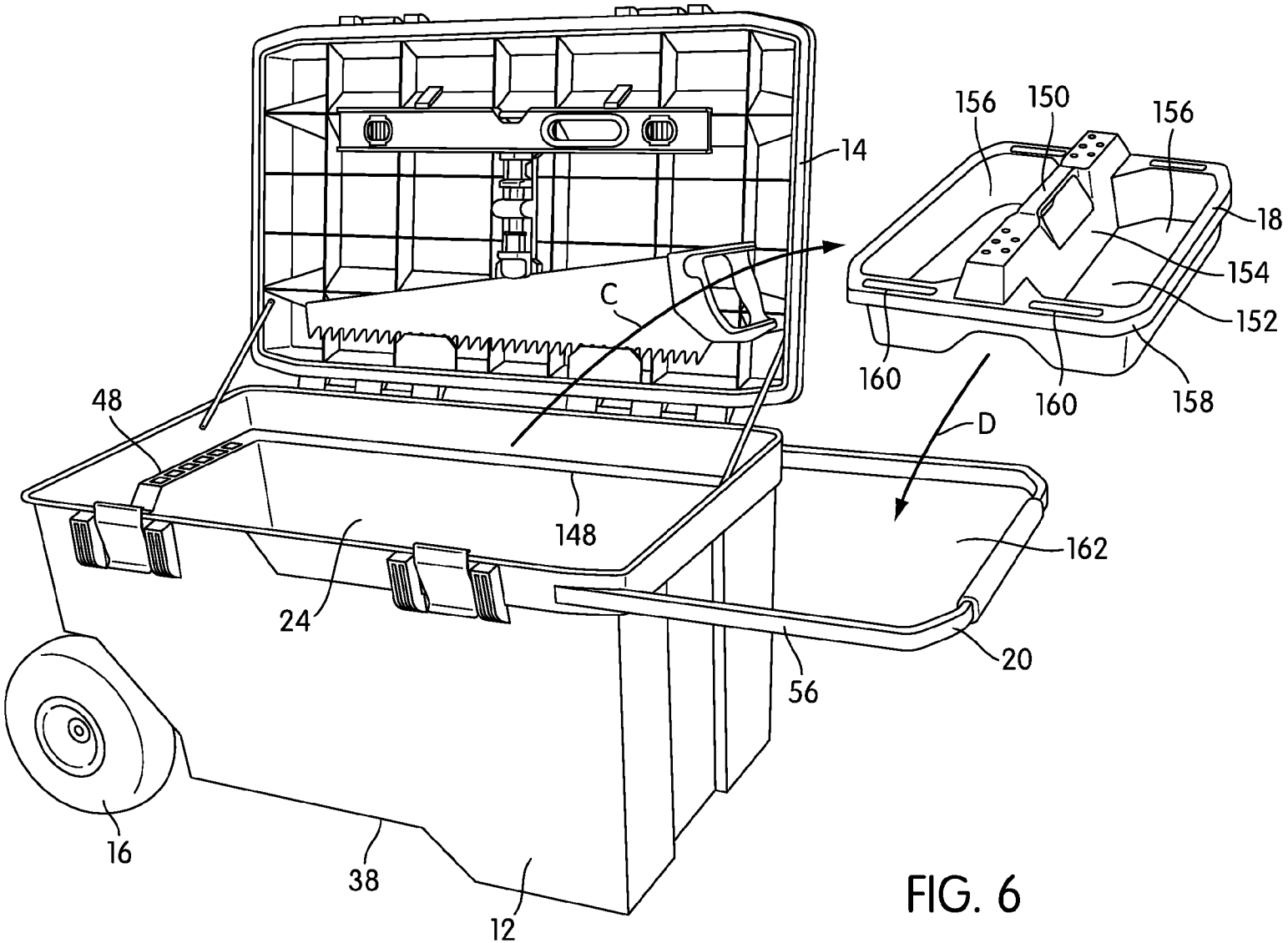
FIG. 6 is a perspective view of the tool container assembly, wherein a removable tool tray is removed from base container in accordance with an embodiment of the present invention.

FIG. 6 shows the operation of removing the tool tray 18 from the storage space 22 and securely engaging with handle 20 when the handle 20 is in extended position. The tool tray 18 that is stored in the storage space 22 of the base container 12 with its peripheral flange 158 resting against the lip 148 of the base container 12 is lifted upwardly using the handle 150. Once the tool tray 18 is removed from the storage space 22 of the base container 12, the tool tray 18 may be carried by the user using handle 150 to any desired location. In one embodiment, the tool tray 18 may be placed on the horizontal surface 100 (as shown in FIGS. 3, 4, and 5) with the bottom surface 152 of the tool tray 18 resting against the horizontal surface 100. Alternatively, as noted above, the tool tray 18 can optionally be supported by resting its peripheral flange 158 on the legs 56 of the handle 20, when the handle 20 is in the extended position. In such embodiment, the tool tray 18 securely fits in an opening 162 formed in the extended handle 20. The arrow C and D show the operation of removing the tool tray 18 from the storage space and then moving the tool tray 18 to the opening 162. FIG. 1 shows the tool tray 18 after being securely engaged with the legs 56 of the extended handle 20.

Figure 6A:
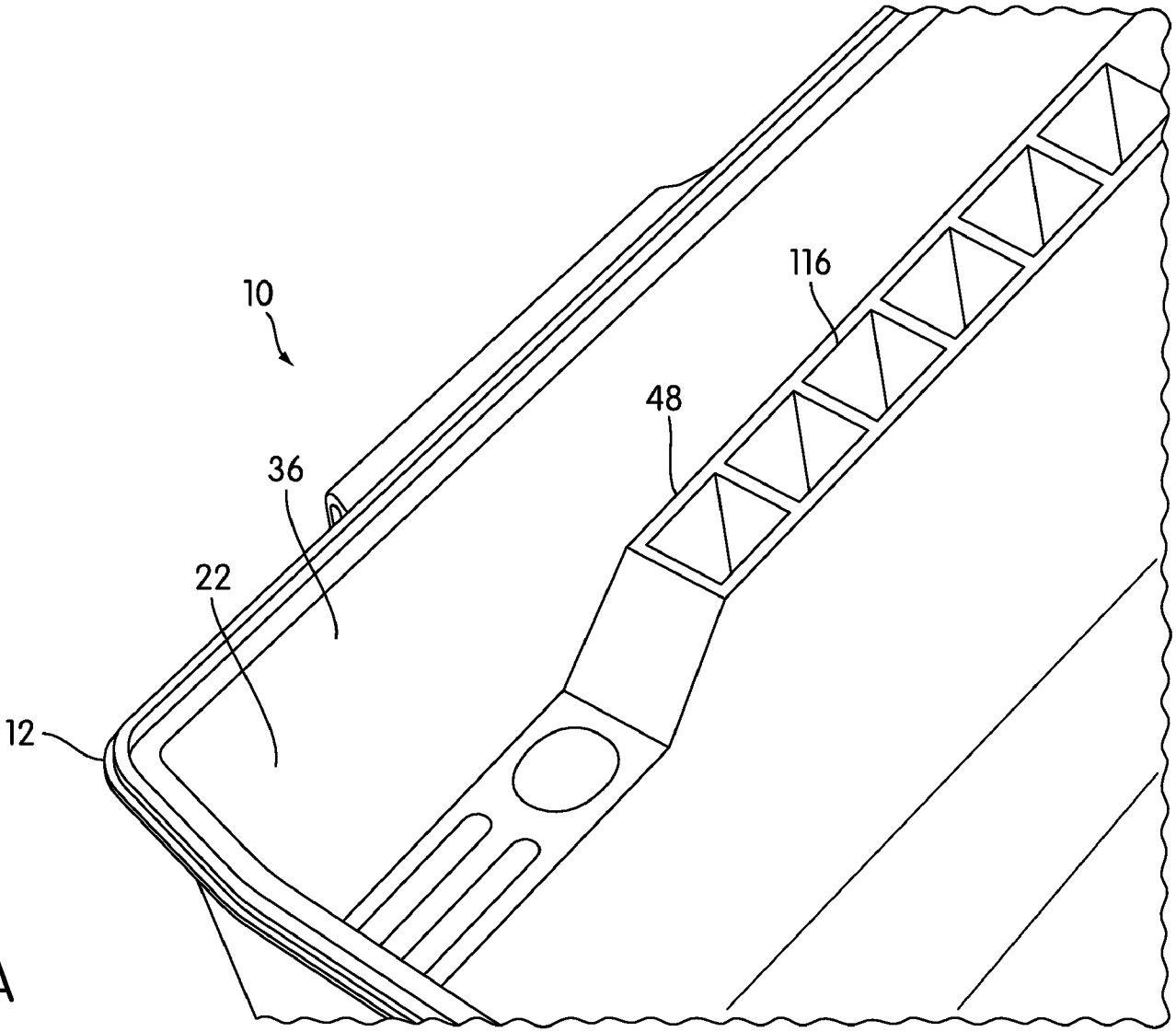
FIG. 6A is a partial perspective view of the tool container assembly, wherein a storage compartment is located in the storage space of base container to store tools and articles in accordance with an embodiment of the present invention.
Figure 6B:
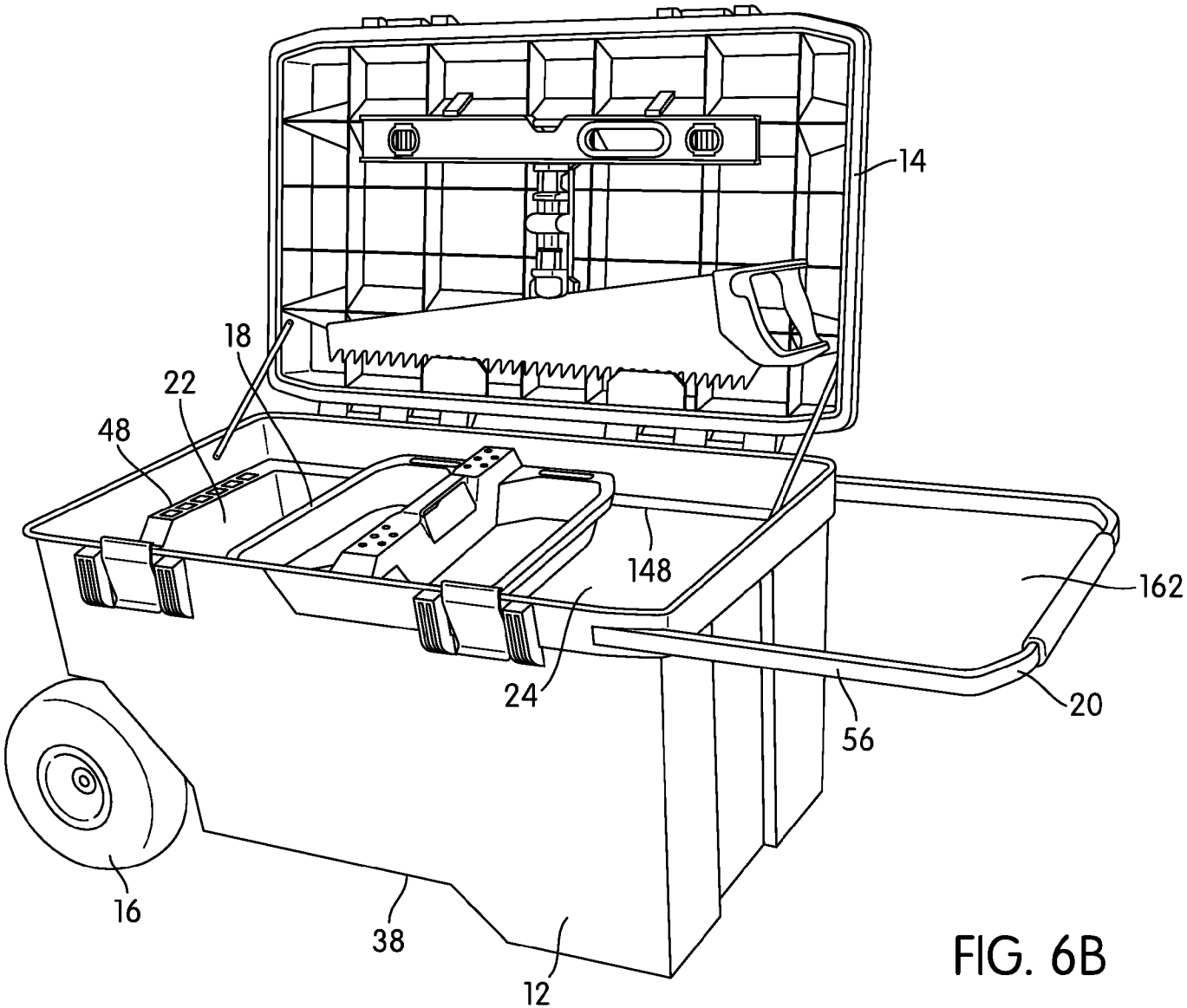
FIG. 6B is a perspective view of the tool container assembly, wherein the removable tool tray is located in the storage space of base container to store tools and articles in accordance with an embodiment of the present invention.

FIG. 6A shows the storage compartment 48 that is constructed and arranged in the storage space 22 of the base container 12 to store one or more tools or articles. In one embodiment, the storage compartment 48 may be integrally formed along the rear wall 36 of the base container 12. Alternatively, in another embodiment, the storage compartment 48 may be constructed and arranged to be attached to any wall of the base container 12 using any retaining or locking structure known in the art. In the illustrated embodiment, the storage compartment 48 may include a plurality of tool storage openings 116. The tool storage openings 116 are constructed and arranged to permit the storage of a variety of articles or tools, such as screw drivers, pliers, scissors, wrenches, or other similar articles or tools having different shapes and sizes. In one embodiment, the tool storage openings 116 may have different shapes, configurations and/or constructions. For example, in one embodiment, the tool storage openings 116 may be in form of longitudinal slots to receive flat tools, such as wrenches. In another embodiment, the tool storage openings 116 may include openings of constant diameter or varying diameter. In one embodiment, the storage compartment 48 may include a forward storage portion and a rearward storage portion, where the forward and the rearward storage portions are arranged in a staged relationship with each other providing the tool storage openings for storing longer tools or articles in the rearward storage portion, and providing the tool storage openings for storing shorter tools or articles in the forward storage portion respectively.

Figure 7:
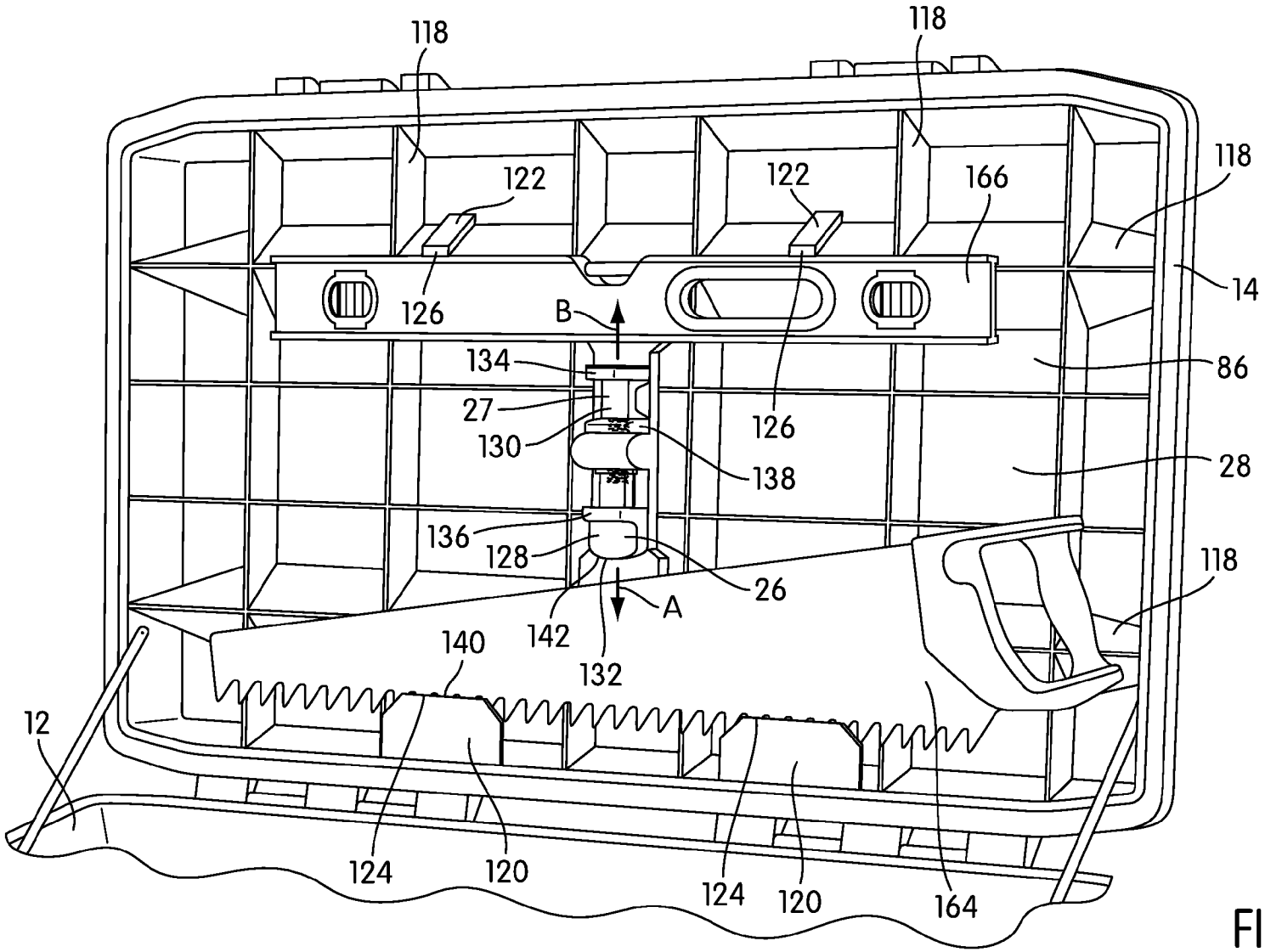
FIG. 7 is a partial perspective view of the cover of the tool container assembly, where manually movable members of clamp assemblies are being moved to a clamp position to clamp tools or articles carried on an inner surface of cover in accordance with an embodiment of the present invention.

FIGS. 7-10 show clamp assemblies 26 and 27 that are disposed on the inner surface 28 of the cover 14 to clamp tools and articles. In one embodiment, as shown in FIG. 7, a plurality of longitudinal and horizontal ribs 118 that are formed in the recess 86 of the cover 14. In one embodiment, the longitudinal and horizontal ribs 118 are constructed and arranged to provide support edges against which the tools or articles are disposed as the tools or articles are being clamped by the clamp assemblies 26 and/or 27.

In one embodiment, the tool container assembly 10 may include clamp assemblies that are constructed and arranged to clamp tools or articles having different shapes, configurations and/or constructions. For example, in one embodiment, the clamp assembly 26 is constructed and arranged to clamp a tool or article with a pointed or sharp edge, such as a handsaw 164. In another embodiment, the clamp assembly 27 is constructed and arranged to clamp a tool or article with planar edges, such as level 166. The clamp assemblies 26 and 27 comprise stationary supports 120 and 122 respectively to support the tool or article. In one embodiment, the stationary supports 120 and 122 are integrally formed on or as part of the inner surface 28 of the cover 14. In another embodiment, the stationary supports 120 and 122 may be attached to the inner surface 28 of the cover 14 by any of several well known attachment mechanisms such as riveting, welding, bolting or any other fastening mechanism as would be appreciated by one skilled in the art. The stationary supports 120 and 122 may be considered to comprise stationary clamping jaws 124 and 126, respectively, to support the tool or article being clamped. In one embodiment, for example in the case of the clamp assembly 26, the clamping jaw 124 or the stationary support 120 comprises a longitudinal slot or a groove 140 to accommodate a portion (e.g., the cutting edge of the handsaw) of the tool or article therewithin and to support the tool or article accommodated in the groove 140. In another embodiment, for example in the case of the clamp assembly 27, the clamping jaw 126 has a generally planar or flat clamp surface for engaging the tool or article. There is no limit to the sizes and shapes of any of the clamp assemblies described herein. In addition, in one embodiment, each clamp assembly 26 and 27 comprises a pair of movable jaws rather than a movable and fixed jaw.

The clamp assemblies 26 and 27 comprise movable supports 128 and 130, respectively, to clamp tools or articles. In one embodiment, the movable supports 128 and 130 are formed on the inner surface 28 of the cover 14. In another embodiment, the movable supports 128 and 130 may be attached to the inner surface 28 of the cover 14 by any of several well known attachment mechanisms such as riveting, welding, bolting or any other fastening mechanism as would be appreciated by one skilled in the art. In one embodiment, the movable supports 128 and 130 are spring biased so as to apply a clamp force in the direction of arrows A and B respectively (as shown in FIG. 7) to the tool or article to be clamped. In this embodiment, the movable supports 128 and 130 utilize an internal spring to retain the tool or article in the clamped configuration. The movable supports 128 and 130 comprise clamping jaws 132 and 134, respectively, to clamp tools or articles. The movable supports 128 and 130 comprise manually movable members 136 and 138, respectively. The manually movable members 136 and 138 are movable in a direction against the bias of the internal spring, between a clamp position and a release position. The movement of the manually movable members 136 and 138 from the clamp position to the release position enables the release of the clamped tool or article from the cover 14. In one embodiment, for example in the case of the clamp assembly 26, the clamping jaw 132 of the movable support 128 comprises a longitudinal slot or a groove 142 to accommodate a portion (e.g., an edge of the handsaw) of the tool or article therewithin and to support the tool or article accommodated in the groove 142. In another embodiment, for example in the case of the clamp assembly 27, the clamping jaw 134 can have a generally planar or flat clamp surface. Also, the clamp surface in any embodiment may comprise an elastomeric or rubber material or coating or layer, to enhance gripping action of the clamp assembly.

Figure 8:
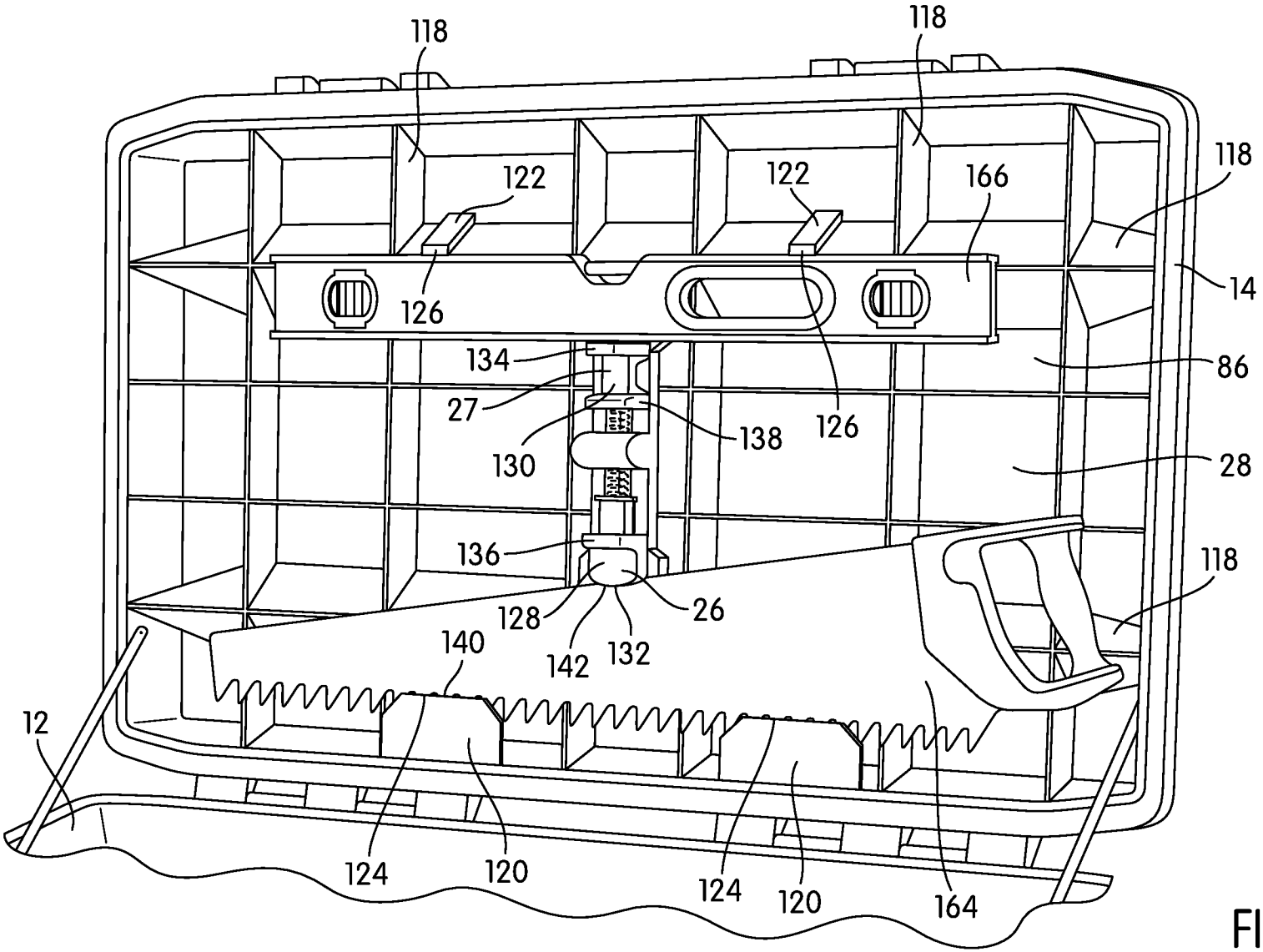
FIG. 8 is a partial perspective view of the cover of the tool container assembly, where the clamp assemblies are in the clamp position to clamp tools or articles carried on the inner surface of the cover in accordance with an embodiment of the present invention.
Figure 9:
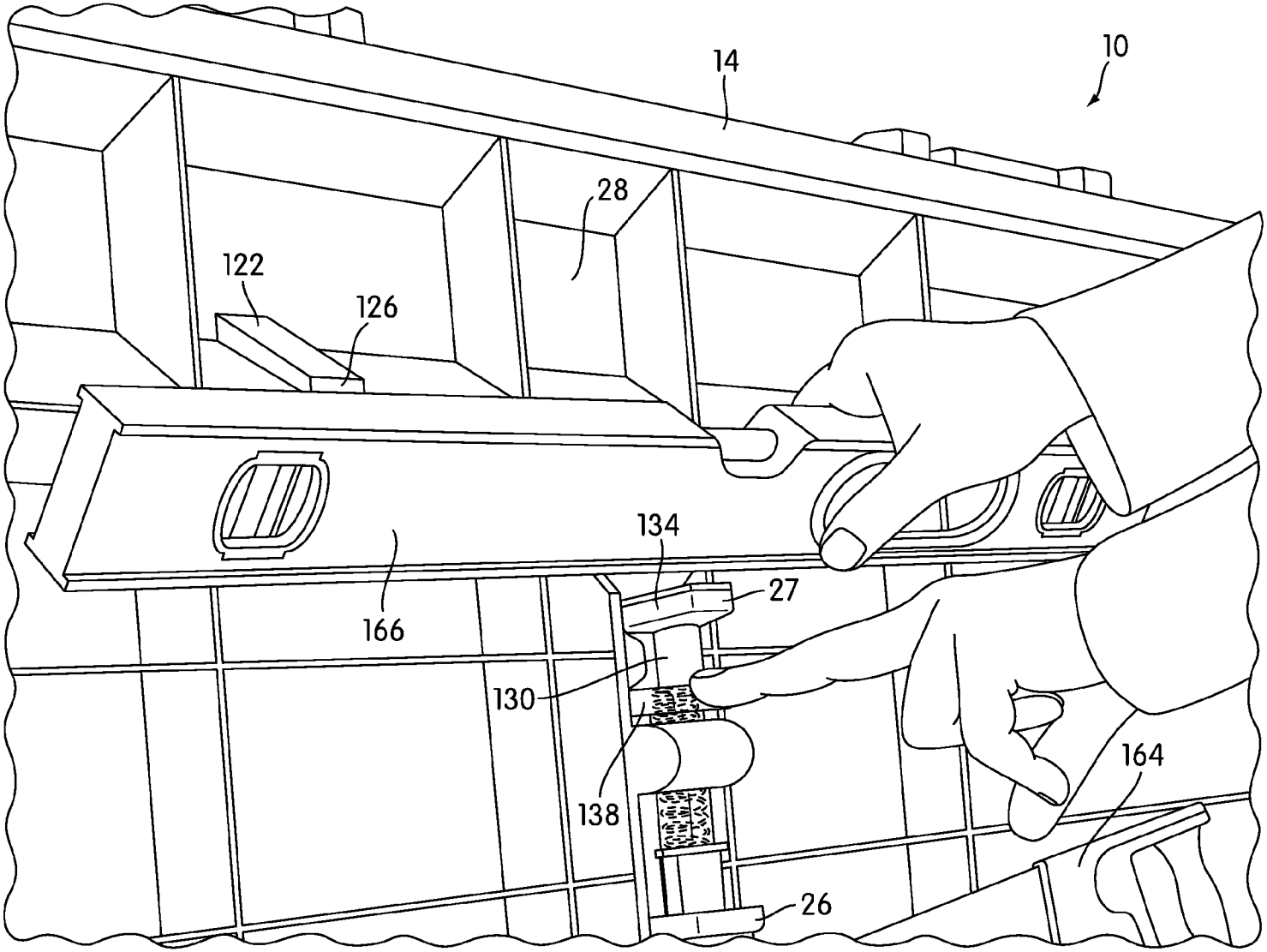
FIG. 9 is a partial perspective view of the tool container assembly, where the manually movable member of the one of the clamp assemblies is moved downwardly to a release position to release tools or articles from the inner surface of the cover in accordance with an embodiment of the present invention.
Figure 10:
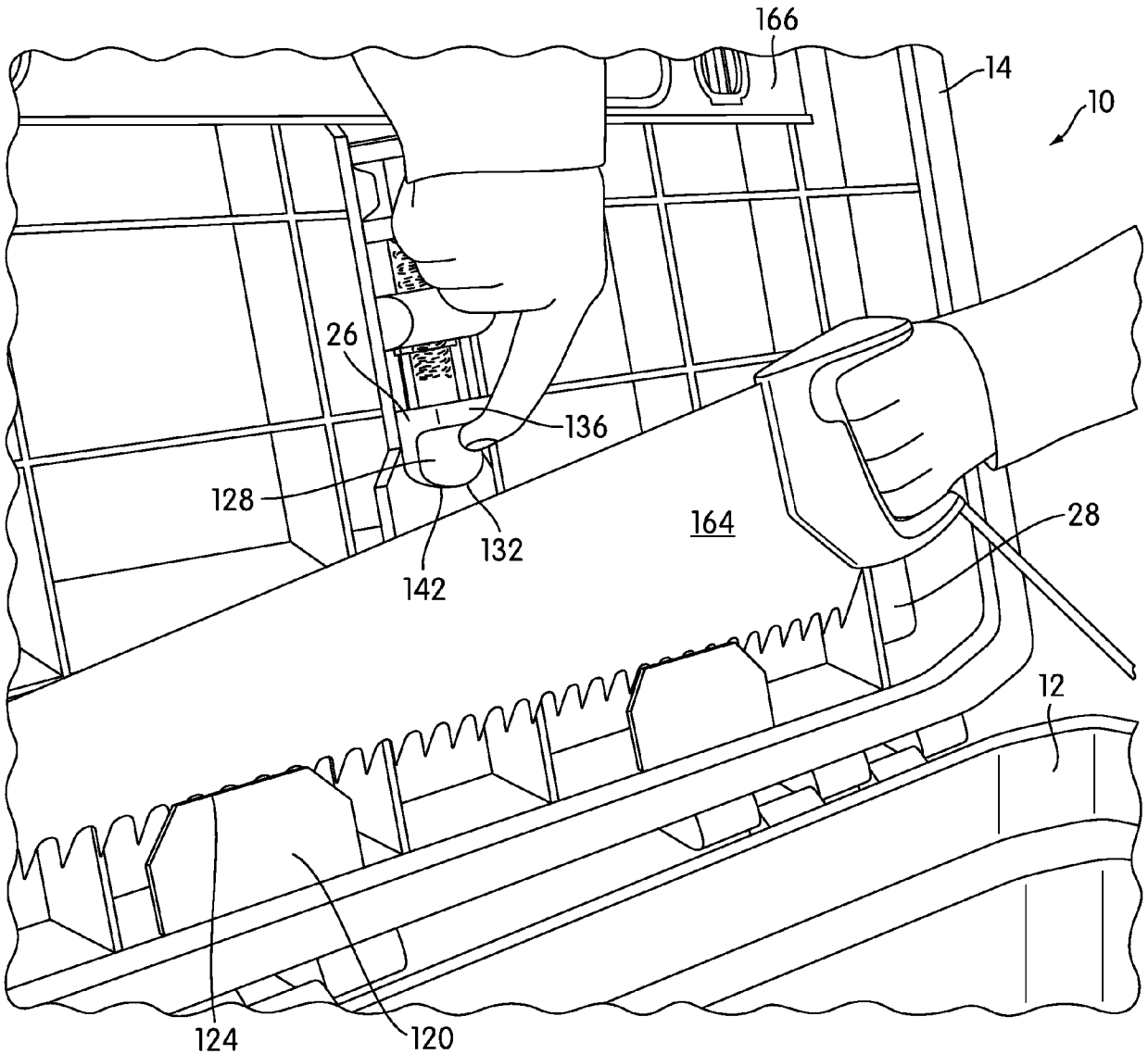
FIG. 10 is a partial perspective view of the tool container assembly, where the manually movable member of the other of the clamp assemblies is moved upwardly to a release position to release tools or articles from the inner surface of the cover in accordance with an embodiment of the present invention.

The operation of the clamp assemblies 26 and 27 is explained here with respect to FIGS. 7, 9 and 10. FIG. 9 shows the operation of the clamp assembly 27 that is constructed and arranged to clamp a tool or article with planar edges, such as level 166. When a user wants to release the tool or article that is clamped by the clamp assembly 27, the user holds the tool or article and moves the manually movable member 138 of the movable support 130 of the clamp assembly 27 downwardly (e.g., in the direction opposite to the clamp force B applied by the internal spring) to lower the clamping jaw 134 that supports the tool or article. Once the clamping jaw 134 is lowered, the user may then simply remove the tool or article from the clamp assembly 27. When the user wants to store/clamp the tool or article, the user moves the manually movable member 138 of the movable support 130 of the clamp assembly 27 downwardly (e.g., in the direction opposite to the clamp force B) to lower the clamping jaw 134, and places the tool or article on the clamping jaw 126 of the stationary support 122 of the clamp assembly 27. The spring in the manually movable member 138 of the movable support 130 of the clamp assembly 27 biases the manually movable member 138 upwardly (e.g., in the direction of the clamp force B) into a clamp position (as shown in FIGS. 7 and 8) and applies the clamp force B to the tool or article to be clamped after the user releases the manually movable member 138.

FIG. 10 shows the operation of the clamp assembly 26 that is constructed and arranged to clamp a tool or article with cutting edges, such as a handsaw. When a user wants to release the tool or article that is clamped by the clamp assembly 26, the user holds the tool or article and moves the manually movable member 136 of the movable support 128 of the clamp assembly 26 upwardly (e.g., in the direction opposite to the clamp force A provided by the internal spring) to raise the clamping jaw 132 that supports the tool or article. Once the clamping jaw 132 is raised, the user may then simply remove the tool or article from the clamp assembly 26. When the user wants to store/clamp the tool or article, the user moves the manually movable member 136 of the movable support 128 of the clamp assembly 26 upwardly (e.g., in the direction opposite to the clamp force A) to raise the clamping jaw 132, and places the tool or article in the longitudinal slot or a groove 140 of the clamping jaw 124 of the stationary support 120 of the clamp assembly 26. The spring in the manually movable member 136 of the movable support 128 of the clamp assembly 26 biases the manually movable member 136 downwardly into a clamp position (as shown in FIGS. 7 and 8) and applies the clamp force A to the tool or article to be clamped after the user releases the manually movable member 136.

Figure 11:
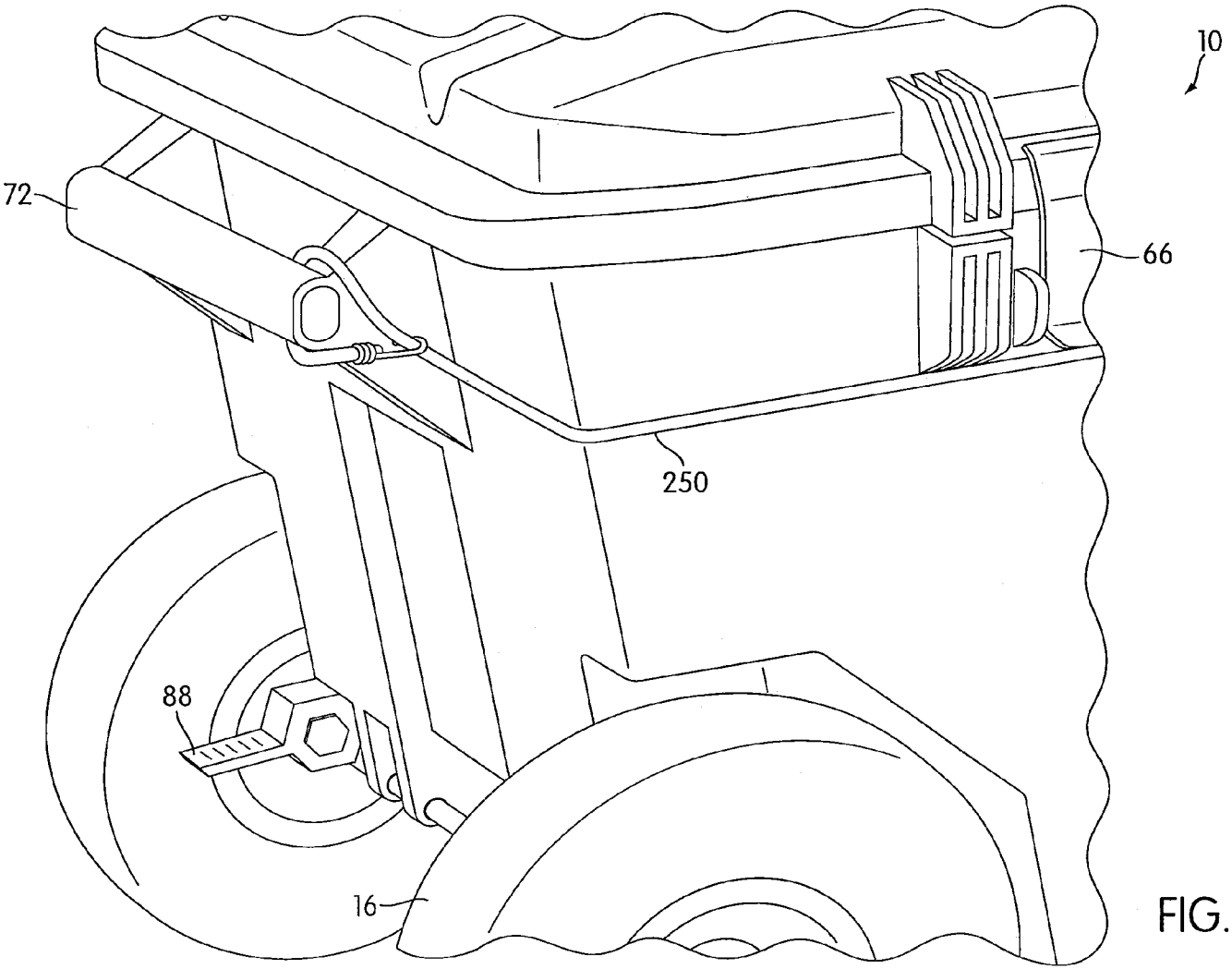
FIG. 11 is a partial perspective view of the tool container assembly, where a lanyard is connected to the handle to dock the took container assembly to a vehicle in accordance with an embodiment of the present invention.

In one embodiment, as shown in FIG. 11, the tool container assembly 10 may be docked using the handles 20 and 72 to a vehicle (not shown). A lanyard 250 is used to connect the handles 20 and 72 to vehicle hooks (not shown). In one embodiment, the lanyard 250 is made of elastic material (e.g., the one used to make a bungee cord). In another embodiment, the lanyard 250 is made of a non-elastic material.

Figure 12:
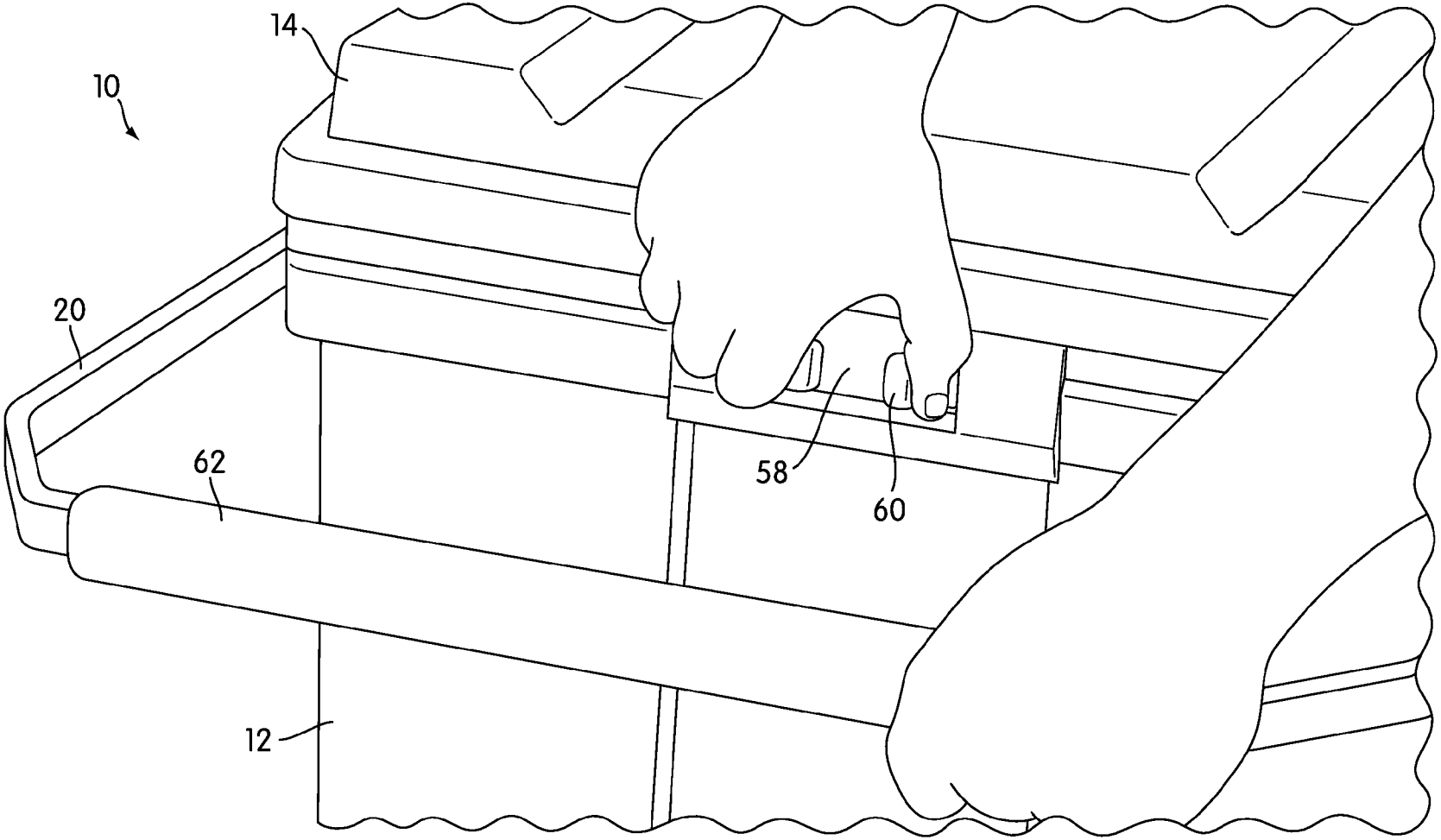
FIG. 12 is a partial perspective view of the tool container assembly, where a handle release member of a lock for locking the extendable handle is movable between a lock position and a release position in accordance with an embodiment of the present invention.

FIG. 12 shows the lock 58 having the handle release member 60. The release member 60 is movable between a lock position and a release position, wherein the movement of the handle release member 60 from the lock position to the release position enables the handle 20 to be unlocked and pulled outwardly from the base container 12.

In one embodiment, the handle release member 60 is constructed and arranged to lock and release the legs 56 of the handle 20 from the lock 58. To move the handle 20 in or out, a user may operate the handle release member 60 to release the legs 56 of the handle from the lock 58. The lock 58 may be any suitable mechanism known in the art to restrict movement of a telescopically received tube or rod, such as a tension grip, notch and catch, etc.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A tool container assembly, the container assembly comprising:

a base container having a storage space and defining an upwardly facing opening into the storage space;

a cover, the cover being movable between a closed position wherein the cover substantially covers the upwardly facing opening and an open position wherein the cover exposes the upwardly facing opening;

rollers connected with the base container to enable transport of the tool container assembly;

a removable tool tray constructed and arranged to be removably carried by the base container, the tool tray configured to store articles or tools therein, and the tool tray arranged to be contained within the container assembly with the cover in the closed position; and an extendable handle movable between extended and retracted positions, the extendable handle operatively connected to the base container to facilitate tilted rolling transport of the tool container assembly when in the extended position;

wherein the extendable handle and the removable tool tray are dimensioned and shaped such that when the handle is in the extended position the removable tray is configured to securely engage and be supported by the extendable handle.

2. The tool container assembly of claim 1, further comprising a storage compartment disposed in the storage space of the base container.

3. The tool container assembly of claim 1, further comprising a lifting handle that is integrally molded with the base container, wherein the lifting handle, in combination with the extendable handle, is constructed and arranged to enable the user to lift and carry the tool container assembly.

4. The tool container assembly of claim 1, wherein a lock assembly is constructed and arranged to lock the cover in the closed position.

5. The tool container assembly of claim 1, wherein a recess formed in opposing side walls and a rear wall of the base container, the recess receiving the rollers.

6. The tool container assembly of claim 1, wherein the rollers are a pair of wheels.

7. The tool container assembly of claim 1, wherein the removable tool tray comprises a handle and one or more container regions.

8. The tool container assembly of claim 1, wherein the extendable handle is movable between an extended position wherein the handle facilitates tilted rolling transport of the tool container assembly and a retracted storage position.

9. The tool container assembly of claim 8, further comprising a lock for locking the extendable handle when the handle is in retracted position.

10. The tool container assembly of claim 9, wherein the lock comprises a handle release member movable between a lock position and a release position, wherein the movement of the handle release member from the lock position to the release position enables the handle to be unlocked and pulled outwardly from the base container.

11. The tool container assembly of claim 1, further comprising a clamp assembly carried by an inner surface of the cover to clamp tools or articles to the cover.

12. The tool container assembly of claim 11, wherein the clamp assembly is spring biased so as to apply a clamp force to the tool or article to be clamped.

13. The tool container assembly of claim 11, wherein the clamp assembly comprises a movable member and a fixed member.

14. The tool container assembly of claim 1, further comprising a roller lock constructed and arranged to lock the rollers against rolling motion.

15. A tool container assembly, the container assembly comprising:

a base container having a storage space for transporting articles therein and defining an upwardly facing opening into the storage space to enable access to stored articles through the upwardly facing opening;

a cover, the cover being movable between a closed position wherein the cover substantially covers the upwardly facing opening and an open position wherein the cover exposes the upwardly facing opening;

rollers connected with the base container to enable transport of the tool container assembly;

an extendable handle operatively connected to the base container to facilitate tilted rolling transport of the tool container assembly; and a clamp assembly disposed on an inner surface of the cover to clamp a tool or article to the cover, wherein the clamp assembly is arranged to suspend the tool or article above the storage space when the cover is in the closed position, wherein the clamp assembly comprises a spring and a manually movable member movable between a clamp position and a release position, wherein the spring biases the manually movable member to the clamp position and wherein the movement of the manually movable member from the clamp position to the release position against the bias of the spring enables the release of a clamped tool or article from the cover.

16. The tool container assembly of claim 15, wherein the clamp assembly comprises a stationary support to support the tool or article.

17. The tool container assembly of claim 16, wherein the stationary support comprises a groove to accommodate a portion of the tool or article to be clamped.

18. The tool container assembly of claim 17, wherein the stationary support comprises a generally planar clamp surface.

19. The tool container assembly of claim 15, further comprising a level clamped to the cover by the clamp assembly.

20. The tool container assembly of claim 15, further comprising a saw clamped to the cover by the clamp assembly.

21. The tool container assembly of claim 15, further comprising a second clamp assembly disposed on the inner surface for clamping an additional tool or article to the cover.

* * * * *